US008282361B2

(12) United States Patent
Mehlhorn et al.

(10) Patent No.: US 8,282,361 B2
(45) Date of Patent: Oct. 9, 2012

(54) CONTROLLER FOR A MOTOR AND A METHOD OF CONTROLLING THE MOTOR

(75) Inventors: William Louis Mehlhorn, Menomonee Falls, WI (US); Andrew William Phillips, Columbia, SC (US)

(73) Assignee: Regal Beloit EPC Inc., Beloit, WI (US)

( * ) Notice: Subject to any disclaimer, the term of this patent is extended or adjusted under 35 U.S.C. 154(b) by 466 days.

(21) Appl. No.: 12/506,349

(22) Filed: Jul. 21, 2009

(65) Prior Publication Data

US 2009/0290991 A1 Nov. 26, 2009

Related U.S. Application Data

(62) Division of application No. 11/102,070, filed on Apr. 8, 2005.

(60) Provisional application No. 60/561,063, filed on Apr. 9, 2004.

(51) Int. Cl.
*F04B 49/06* (2006.01)

(52) U.S. Cl. ..... 417/53; 417/44.11

(58) Field of Classification Search ..... 417/44.11, 417/53; 318/434

See application file for complete search history.

(56) References Cited

U.S. PATENT DOCUMENTS

| | | | |
|---|---|---|---|
| 1,061,919 | A | 5/1913 | Miller |
| 2,767,277 | A | 10/1956 | Wirth |
| 3,191,935 | A | 6/1965 | Uecker |
| 3,558,910 | A | 1/1971 | Dale et al. |
| 3,617,839 | A | 11/1971 | Hill |
| 3,781,925 | A | 1/1974 | Curtis et al. |
| 3,838,597 | A | 10/1974 | Montgomery |
| 3,953,777 | A | 4/1976 | McKee |
| 3,963,375 | A | 6/1976 | Curtis |
| 4,021,700 | A | 5/1977 | Ellis-Anwyl |
| 4,168,413 | A | 9/1979 | Halpine |
| 4,185,187 | A | 1/1980 | Rogers |
| 4,319,712 | A | 3/1982 | Bar |

(Continued)

FOREIGN PATENT DOCUMENTS

DE 2946049 5/1981

(Continued)

OTHER PUBLICATIONS

United States Patent Office Action for U.S. Appl. No. 11/102,070 dated Jan. 20, 2011 (26 pages).

(Continued)

*Primary Examiner* — Devon Kramer
*Assistant Examiner* — Philip Stimpert
(74) *Attorney, Agent, or Firm* — Michael Best & Friedrich LLP

(57) ABSTRACT

A method of controlling a motor operating a pumping apparatus of a fluid-pumping application. The pumping apparatus includes a pump having an inlet to receive a fluid and an outlet to exhaust the fluid, and the motor coupled to the pump to operate the pump. The method includes the acts of controlling the motor to operate the pump and monitoring the operation of the pump. The monitoring act includes monitoring a power of the motor, and determining whether the monitored power indicates an undesired flow of fluid through the pump. The method further includes the act of controlling the motor to cease operation of the pump when the determination indicates an undesired flow of fluid through the pump and zero or more other conditions exist.

17 Claims, 8 Drawing Sheets

U.S. PATENT DOCUMENTS

| | | | | |
|---|---|---|---|---|
| 4,370,098 | A | 1/1983 | McClain et al. | |
| 4,371,315 | A | 2/1983 | Shikasho | |
| 4,420,787 | A | 12/1983 | Tibbits et al. | |
| 4,428,434 | A | 1/1984 | Gelaude | |
| 4,449,260 | A | 5/1984 | Whitaker | |
| 4,473,338 | A | 9/1984 | Garmong | |
| 4,504,773 | A | 3/1985 | Suzuki et al. | |
| 4,505,643 | A | 3/1985 | Millis et al. | |
| 4,514,989 | A | 5/1985 | Mount | |
| 4,541,029 | A | 9/1985 | Ohyama | |
| 4,581,900 | A | 4/1986 | Lowe et al. | |
| 4,620,835 | A | 11/1986 | Bell | |
| 4,647,825 | A | 3/1987 | Profio et al. | |
| 4,676,914 | A | 6/1987 | Millis et al. | |
| 4,678,404 | A | 7/1987 | Lorett et al. | |
| 4,695,779 | A | 9/1987 | Yates | |
| 4,697,464 | A | 10/1987 | Martin | |
| 4,703,387 | A | 10/1987 | Miller | |
| 4,758,697 | A | 7/1988 | Jeuneu | |
| 4,781,525 | A | 11/1988 | Hubbard et al. | |
| 4,837,656 | A | 6/1989 | Barnes | |
| 4,839,571 | A | 6/1989 | Farnham et al. | |
| 4,841,404 | A | 6/1989 | Marshall et al. | |
| 4,864,287 | A | 9/1989 | Kierstead | |
| 4,885,655 | A | 12/1989 | Springer et al. | |
| 4,896,101 | A | 1/1990 | Cobb | |
| 4,907,610 | A | 3/1990 | Meincke | |
| 4,971,522 | A | 11/1990 | Butlin | |
| 4,996,646 | A | 2/1991 | Farrington | |
| 4,998,097 | A | 3/1991 | Noth et al. | |
| 5,079,784 | A | 1/1992 | Rist et al. | |
| 5,100,298 | A | 3/1992 | Shibata et al. | |
| RE33,874 | E | 4/1992 | Miller | |
| 5,167,041 | A | 12/1992 | Burkitt, III | |
| 5,172,089 | A | 12/1992 | Wright et al. | |
| 5,234,286 | A | 8/1993 | Wagner | |
| 5,255,148 | A | 10/1993 | Yeh | |
| 5,324,170 | A | 6/1994 | Anastos et al. | |
| 5,347,664 | A | 9/1994 | Hamza et al. | |
| 5,361,215 | A | 11/1994 | Tompkins et al. | |
| 5,422,014 | A | 6/1995 | Allen et al. | |
| 5,473,497 | A * | 12/1995 | Beatty | 361/23 |
| 5,545,012 | A | 8/1996 | Anastos et al. | |
| 5,548,854 | A | 8/1996 | Bloemer et al. | |
| 5,550,753 | A | 8/1996 | Tompkins et al. | |
| 5,559,720 | A | 9/1996 | Tompkins et al. | |
| 5,570,481 | A | 11/1996 | Mathis et al. | |
| 5,577,890 | A | 11/1996 | Nielsen et al. | |
| 5,601,413 | A | 2/1997 | Langley et al. | |
| 5,624,237 | A | 4/1997 | Prescott et al. | |
| 5,632,468 | A | 5/1997 | Schoenmeyr | |
| 5,633,540 | A | 5/1997 | Moan | |
| 5,690,476 | A | 11/1997 | Miller | |
| 5,727,933 | A | 3/1998 | Laskaris et al. | |
| 5,777,833 | A | 7/1998 | Romilion | |
| 5,820,350 | A | 10/1998 | Mantey et al. | |
| 5,833,437 | A | 11/1998 | Kurth et al. | |
| 5,907,281 | A | 5/1999 | Miller, Jr. et al. | |
| 5,930,092 | A | 7/1999 | Nystrom | |
| 5,947,700 | A | 9/1999 | McKain et al. | |
| 5,959,534 | A | 9/1999 | Campbell et al. | |
| 5,977,732 | A | 11/1999 | Matsumoto | |
| 6,043,461 | A | 3/2000 | Holling et al. | |
| 6,045,333 | A | 4/2000 | Breit | |
| 6,059,536 | A | 5/2000 | Stingl | |
| 6,092,992 | A | 7/2000 | Imblum et al. | |
| 6,157,304 | A | 12/2000 | Bennett et al. | |
| 6,171,073 | B1 | 1/2001 | McKain et al. | |
| 6,199,224 | B1 | 3/2001 | Versland | |
| 6,213,724 | B1 | 4/2001 | Haugen et al. | |
| 6,216,814 | B1 | 4/2001 | Fujita et al. | |
| 6,227,808 | B1 * | 5/2001 | McDonough | 417/44.2 |
| 6,238,188 | B1 | 5/2001 | Lifson | |
| 6,247,429 | B1 * | 6/2001 | Hara et al. | 123/41.44 |
| 6,253,227 | B1 | 6/2001 | Tompkins et al. | |
| 6,342,841 | B1 | 1/2002 | Stingl | |
| 6,354,805 | B1 | 3/2002 | Moller | |
| 6,364,621 | B1 | 4/2002 | Yamauchi | |
| 6,390,781 | B1 | 5/2002 | McDonough | |
| 6,468,042 | B2 | 10/2002 | Moller | |
| 6,468,052 | B2 | 10/2002 | McKain et al. | |
| 6,481,973 | B1 | 11/2002 | Struthers | |
| 6,501,240 | B2 | 12/2002 | Ueda et al. | |
| 6,501,629 | B1 | 12/2002 | Marriott | |
| 6,504,338 | B1 | 1/2003 | Eichorn | |
| 6,522,034 | B1 | 2/2003 | Nakayama | |
| 6,534,940 | B2 | 3/2003 | Bell et al. | |
| 6,534,947 | B2 | 3/2003 | Johnson et al. | |
| 6,543,940 | B2 | 4/2003 | Chu | |
| 6,590,188 | B2 | 7/2003 | Cline et al. | |
| 6,595,762 | B2 | 7/2003 | Khanwilkar et al. | |
| 6,616,413 | B2 | 9/2003 | Humpheries | |
| 6,623,245 | B2 | 9/2003 | Meza et al. | |
| 6,625,519 | B2 | 9/2003 | Goodwin et al. | |
| 6,636,135 | B1 | 10/2003 | Vetter | |
| 6,638,023 | B2 | 10/2003 | Scott | |
| 6,676,831 | B2 | 1/2004 | Wolfe | |
| 6,696,676 | B1 | 2/2004 | Graves et al. | |
| 6,709,240 | B1 | 3/2004 | Schmalz et al. | |
| 6,715,996 | B2 | 4/2004 | Moeller | |
| 6,732,387 | B1 | 5/2004 | Waldron | |
| 6,768,279 | B1 | 7/2004 | Skinner et al. | |
| 6,806,677 | B2 | 10/2004 | Kelly et al. | |
| 6,832,898 | B2 | 12/2004 | Yoshida et al. | |
| 6,875,961 | B1 | 4/2005 | Collins | |
| 6,895,608 | B2 | 5/2005 | Goettl | |
| 6,906,482 | B2 | 6/2005 | Shimizu et al. | |
| 6,933,693 | B2 | 8/2005 | Schuchmann | |
| 6,941,785 | B2 | 9/2005 | Haynes et al. | |
| 6,965,815 | B1 | 11/2005 | Tompkins et al. | |
| 6,976,052 | B2 | 12/2005 | Tompkins et al. | |
| 7,055,189 | B2 | 6/2006 | Goettl | |
| 7,117,120 | B2 | 10/2006 | Beck et al. | |
| 7,163,380 | B2 | 1/2007 | Jones | |
| 7,327,275 | B2 | 2/2008 | Brochu et al. | |
| 2001/0029407 | A1 | 10/2001 | Tompkins et al. | |
| 2002/0175828 | A1 | 11/2002 | Macey | |
| 2002/0176783 | A1 | 11/2002 | Moeller | |
| 2002/0190687 | A1 | 12/2002 | Bell et al. | |
| 2003/0106147 | A1 | 6/2003 | Cohen et al. | |
| 2004/0009075 | A1 | 1/2004 | Meza et al. | |
| 2004/0062658 | A1 | 4/2004 | Beck et al. | |
| 2004/0064292 | A1 | 4/2004 | Beck et al. | |
| 2004/0090197 | A1 | 5/2004 | Schuchmann | |
| 2004/0205886 | A1 | 10/2004 | Goettl | |
| 2004/0213676 | A1 | 10/2004 | Phillips | |
| 2005/0097665 | A1 | 5/2005 | Goettl | |
| 2005/0123408 | A1 | 6/2005 | Koehl | |
| 2005/0133088 | A1 | 6/2005 | Bologeorges | |
| 2005/0158177 | A1 | 7/2005 | Mehlhorn | |
| 2005/0193485 | A1 | 9/2005 | Wolfe | |
| 2005/0226731 | A1 | 10/2005 | Mehlhorn | |
| 2005/0281681 | A1 | 12/2005 | Anderson et al. | |
| 2006/0045750 | A1 | 3/2006 | Stiles | |
| 2006/0090255 | A1 | 5/2006 | Cohen | |
| 2006/0127227 | A1 | 6/2006 | Mehlhorn | |
| 2006/0146462 | A1 | 7/2006 | McMillian, IV | |
| 2006/0220604 | A1 | 10/2006 | Hirai | |
| 2007/0114162 | A1 | 5/2007 | Stiles, Jr. et al. | |
| 2007/0154319 | A1 | 7/2007 | Stiles, Jr. et al. | |
| 2007/0154320 | A1 | 7/2007 | Stiles, Jr. et al. | |
| 2007/0154321 | A1 | 7/2007 | Stiles, Jr. et al. | |
| 2007/0154322 | A1 | 7/2007 | Stiles, Jr. et al. | |
| 2007/0154323 | A1 | 7/2007 | Stiles, Jr. et al. | |
| 2007/0163929 | A1 | 7/2007 | Stiles, Jr. et al. | |
| 2007/0183902 | A1 | 8/2007 | Stiles, Jr. et al. | |
| 2008/0003114 | A1 | 1/2008 | Levin et al. | |
| 2008/0041839 | A1 | 2/2008 | Tran | |
| 2008/0063535 | A1 | 3/2008 | Koehl | |
| 2008/0095638 | A1 | 4/2008 | Branecky | |
| 2008/0095639 | A1 | 4/2008 | Bartos | |
| 2008/0095640 | A1 | 4/2008 | Branecky | |
| 2008/0168599 | A1 | 7/2008 | Caudill et al. | |
| 2009/0280014 | A1 | 11/2009 | Branecky | |
| 2009/0288407 | A1 | 11/2009 | Bartos | |
| 2009/0290989 | A1 | 11/2009 | Mehlhorn | |
| 2009/0290990 | A1 | 11/2009 | Branecky | |

| | | | |
|---|---|---|---|
| 2010/0068073 | A1 | 3/2010 | Branecky |
| 2010/0080714 | A1 | 4/2010 | Mehlhorn |
| 2010/0232981 | A1 | 9/2010 | Branecky |
| 2011/0002792 | A1 | 1/2011 | Bartos |

FOREIGN PATENT DOCUMENTS

| | | |
|---|---|---|
| DE | 19736079 | 2/1999 |
| EP | 0150068 | 7/1985 |
| EP | 0226858 | 7/1987 |
| EP | 0246769 | 11/1987 |
| EP | 0833436 | 4/1998 |
| EP | 1585205 | 10/2005 |
| JP | 355072678 | 5/1980 |
| WO | WO 2005/111473 | 11/2005 |
| WO | 2010/039580 | 4/2010 |

OTHER PUBLICATIONS

European Patent Office Action for Application No. 07250159.6 dated Jul. 20, 2011 (8 pages).
Joe Cohen; signed letter to Sheldon L. Wolfe; 1 page.
Sta-Rite Industries, Inc.; Facsimile; 1 page.
Fail-Safe, LLC and Sta-Rite Industries, Inc.; Non-Disclosure Agreement; 2 pages.
Author unknown; Safety Vacuum Release Valve from Fail Safe; 1 page.
Author unknown; Request for Lab Project; 3 pages.
Joe Cohen; signed letter to Gary Brooks; 1 page.
Author unknown; "Suction Safe" Swimming Pool Pump: Simulated Field-test; 3 pages.
Author unknown; General Worksheet: Fail-Safe Vacuum Release Valve W/ Franklin 2.6 hp "Load Tech" motor on Vinyl Liner Pool; 3 pages.
Richard Meyer; Orifices for Fail-Safe assembly, 1 page.
Failsafe, LLC, Save Lives! Use Fail-Safe Suction-Safe Pool & Spa Pumps, brochure (Dec. 31, 2000), 4 pages, Aurora, Colorado.
Failsafe, LLC, Suction-Safe Pool & Spa Pump Operator's Manual, brochure (Apr. 8, 2003) 12 pages, Aurora, Colorado.
Sta-Rite Industries, Inc., "60 Cycle 'C' and 'CC' Series Centrifugal Pumps for Swimming Pool Use—Owner's Manual," S408 (Dec. 10, 2002) 16 pages).
European Patent Office Search Report for Application No. 05252215.8 dated Oct. 30, 2008 (3 pages).
United States Patent Office Action for U.S. Appl. No. 11/102,070 dated Feb. 13, 2008, 15 pages.
United States Patent Office Action for U.S. Appl. No. 11/102,070 dated Feb. 19, 2009 (6 pages).
United States Patent Office Action for U.S. Appl. No. 11/102,070 dated Nov. 30, 2009 (10 pages).
United States Patent Office Action for U.S. Appl. No. 11/348,958 dated Sep. 14, 2010 (12 pages).
United States Patent Office Action for U.S. Appl. No. 11/348,958 dated Mar. 1, 2010 (11 pages).
"Affidavit of Commercial Success" filed Nov. 19, 2008 in the United States Patent and Trademark Office for U.S. Appl. No. 11/163,860 signed by Joseph D. Cohen (4 pages).
"Amendment and Response to Examiner's Action Dated May 19, 2008" in the United States Patent and Trademark Office for U.S. Appl. No. 11/163,860 (18 pages).
United States Patent and Trademark Office Action for U.S. Appl. No. 11/163,860 dated Feb. 18, 2009 (6 pages).
"Amendment Under 37 CFR §1.114" filed Aug. 17, 2009 in the United States Patent and Trademark Office for U.S. Appl. No. 11/163,860 (32 pages).
United States Patent and Trademark Office Action for U.S. Appl. No. 11/163,860 dated Oct. 29, 2009 (5 pages).
United States Patent Office Action for U.S. Appl. No. 11/102,070 dated Jun. 18, 2010 (9 pages).
United States Patent Office Action for U.S. Appl. No. 11/348,958 dated Mar. 28, 2011 (10 pages).
United States Patent Office Notice of Allowance for U.S. Appl. No. 11/102,070 dated Nov. 23, 2011 (9 pages).
United States Patent Office Notice of Allowance for U.S. Appl. No. 11/348,958 dated Nov. 14, 2011 (5 pages).
United States Patent Office Notice of Allowance for U.S. Appl. No. 11/102,070 dated Feb. 15, 2012 (6 pages).
United States Patent Office Action for U.S. Appl. No. 12/506,330 dated Mar. 13, 2012 (17 pages).
United States Patent Office Action for U.S. Appl. No. 12/625,111 dated Mar. 12, 2012 (9 pages).
European Patent Office Action for Application No. 05252215.8 dated Feb. 6, 2012 (5 pages).

* cited by examiner

CONTROLLER FOR A MOTOR AND A METHOD OF CONTROLLING THE MOTOR

RELATED APPLICATIONS

This application is a divisional of U.S. patent application Ser. No. 11/102,070, filed Apr. 8, 2005, which claims the benefit of U.S. Provisional Patent Application No. 60/561,063, filed Apr. 9, 2004, both of which are incorporated herein by reference in their entirety.

BACKGROUND

The invention relates to a controller for a motor, and particularly, a controller for a motor operating a pump.

Occasionally on a swimming pool, spa, or similar jetted-fluid application, the main drain can become obstructed with an object, such as a towel or pool toy. When this happens, the suction force of the pump is applied to the obstruction and the object sticks to the drain. This is called suction entrapment. If the object substantially covers the drain (such as a towel covering the drain), water is pumped out of the drain side of the pump. Eventually the pump runs dry, the seals burn out, and the pump can be damaged.

Another type of entrapment is referred to as mechanical entrapment. Mechanical entrapment occurs when an object, such as a towel or pool toy, gets tangled in the drain cover. Mechanical entrapment may also effect the operation of the pump.

Several solutions have been proposed for suction and mechanical entrapment. For example, new pool construction is required to have two drains, so that if one drain becomes plugged, the other can still flow freely and no vacuum entrapment can take place. This does not help existing pools, however, as adding a second drain to an in-ground, one-drain pool is very difficult and expensive. Modern pool drain covers are also designed such that items cannot become entwined with the cover.

As another example, several manufacturers offer systems known as Safety Vacuum Release Systems (SVRS). SVRS often contain several layers of protection to help prevent both mechanical and suction entrapment. Most SVRS use hydraulic release valves that are plumbed into the suction side of the pump. The valve is designed to release (open to the atmosphere) if the vacuum (or pressure) inside the drain pipe exceeds a set threshold, thus releasing the obstruction. These valves can be very effective at releasing the suction developed under these circumstances. Unfortunately, they have several technical problems that have limited their use. The first problem is that when the valve releases, the pump loses its water supply and the pump can still be damaged. The second problem is that the release valve typically needs to be mechanically adjusted for each pool. Even if properly adjusted, the valve can be prone to nuisance trips. The third problem is that the valve needs to be plumbed properly into the suction side of the pump. This makes installation difficult for the average homeowner.

SUMMARY

In one embodiment, the invention provides a controller for a motor that monitors motor input power and/or pump inlet side pressure (also referred to as pump inlet side vacuum). This monitoring helps to determine if a drain obstruction has taken place. If the drain or plumbing is substantially restricted on the suction side of the pump, the pressure on that side of the pump increases. At the same time, because the pump is no longer pumping fluid, input power to the motor drops. Either of these conditions may be considered a fault and the motor is powered down. It is also envisioned that should the pool filter become plugged, the pump input power also drops and the motor is powered down as well.

Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
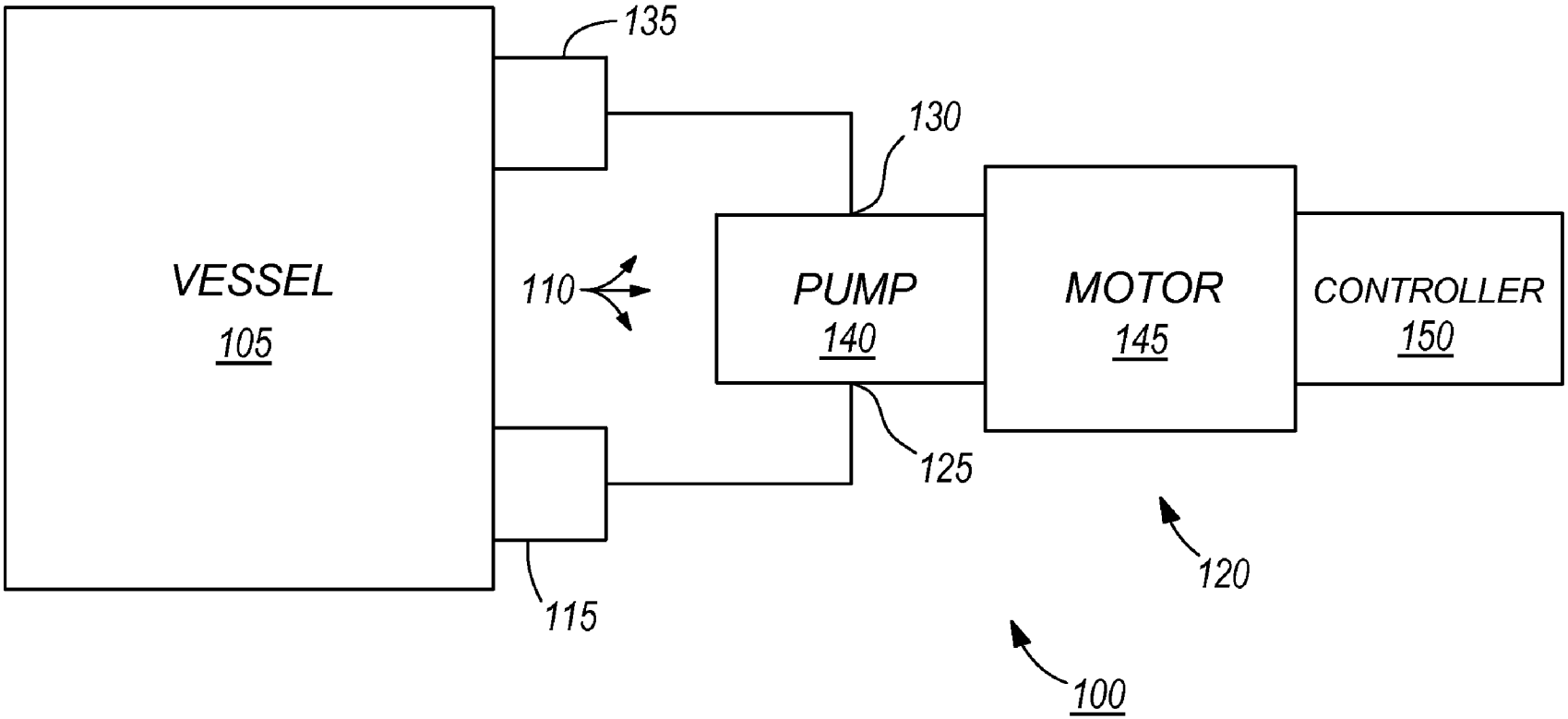
FIG. 1 is a schematic representation of a jetted-spa incorporating the invention.

FIG. 1 schematically represents a jetted-spa 100 incorporating the invention. However, the invention is not limited to the jetted-spa 100 and can be used in other jetted-fluid systems (e.g., pools, whirlpools, jetted-tubs, etc.). It is also envisioned that the invention can be used in other applications (e.g., fluid-pumping applications).

As shown in FIG. 1, the spa 100 includes a vessel 105. As used herein, the vessel 105 is a hollow container such as a tub, pool, tank, or vat that holds a load. The load includes a fluid, such as chlorinated water, and may include one or more occupants or items. The spa further includes a fluid-movement system 110 coupled to the vessel 105. The fluid-movement system 110 includes a drain 115, a pumping apparatus 120 having an inlet 125 coupled to the drain and an outlet 130, and a return 135 coupled to the outlet 130 of the pumping apparatus 120. The pumping apparatus 120 includes a pump 140, a motor 145 coupled to the pump 140, and a controller 150 for controlling the motor 145. For the constructions described herein, the pump 140 is a centrifugal pump and the motor 145 is an induction motor (e.g., capacitor-start, capacitor-run induction motor; split-phase induction motor; three-phase induction motor; etc.). However, the invention is not limited to this type of pump or motor. For example, a brushless, direct current (DC) motor may be used in a different pumping application. For other constructions, a jetted-fluid system can include multiple drains, multiple returns, or even multiple fluid movement systems.

Referring back to FIG. 1, the vessel 105 holds a fluid. When the fluid movement system 110 is active, the pump 140 causes the fluid to move from the drain 115, through the pump 140, and jet into the vessel 105. This pumping operation occurs when the controller 150 controllably provides a power to the motor 145, resulting in a mechanical movement by the motor 145. The coupling of the motor 145 (e.g., a direct coupling or an indirect coupling via a linkage system) to the pump 140 results in the motor 145 mechanically operating the pump 140 to move the fluid. The operation of the controller 150 can be via an operator interface, which may be as simple as an ON switch.

Figure 2:
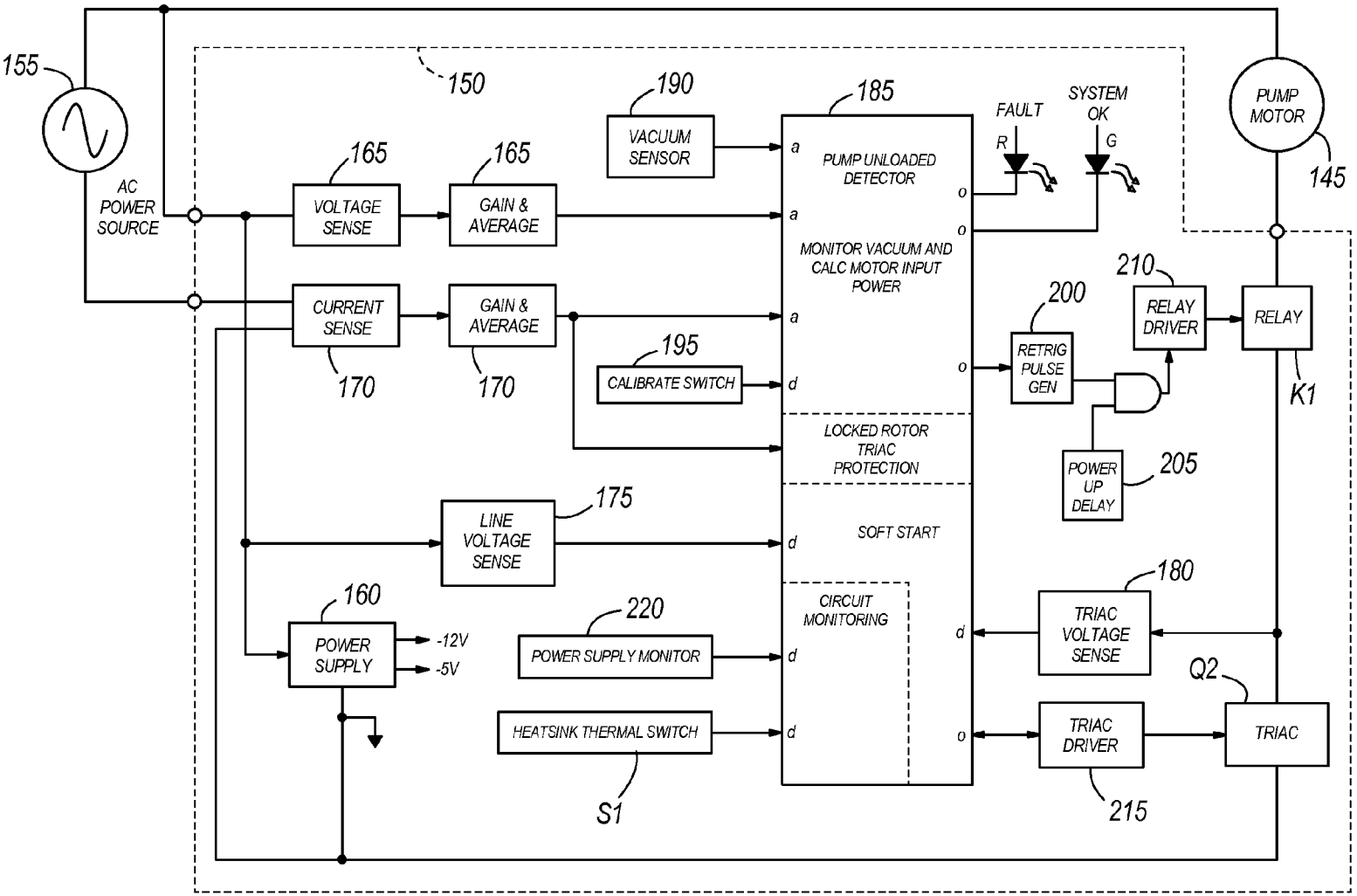
FIG. 2 is a block diagram of a first controller capable of being used in the jetted-spa shown in FIG. 1.
Figure 3A:
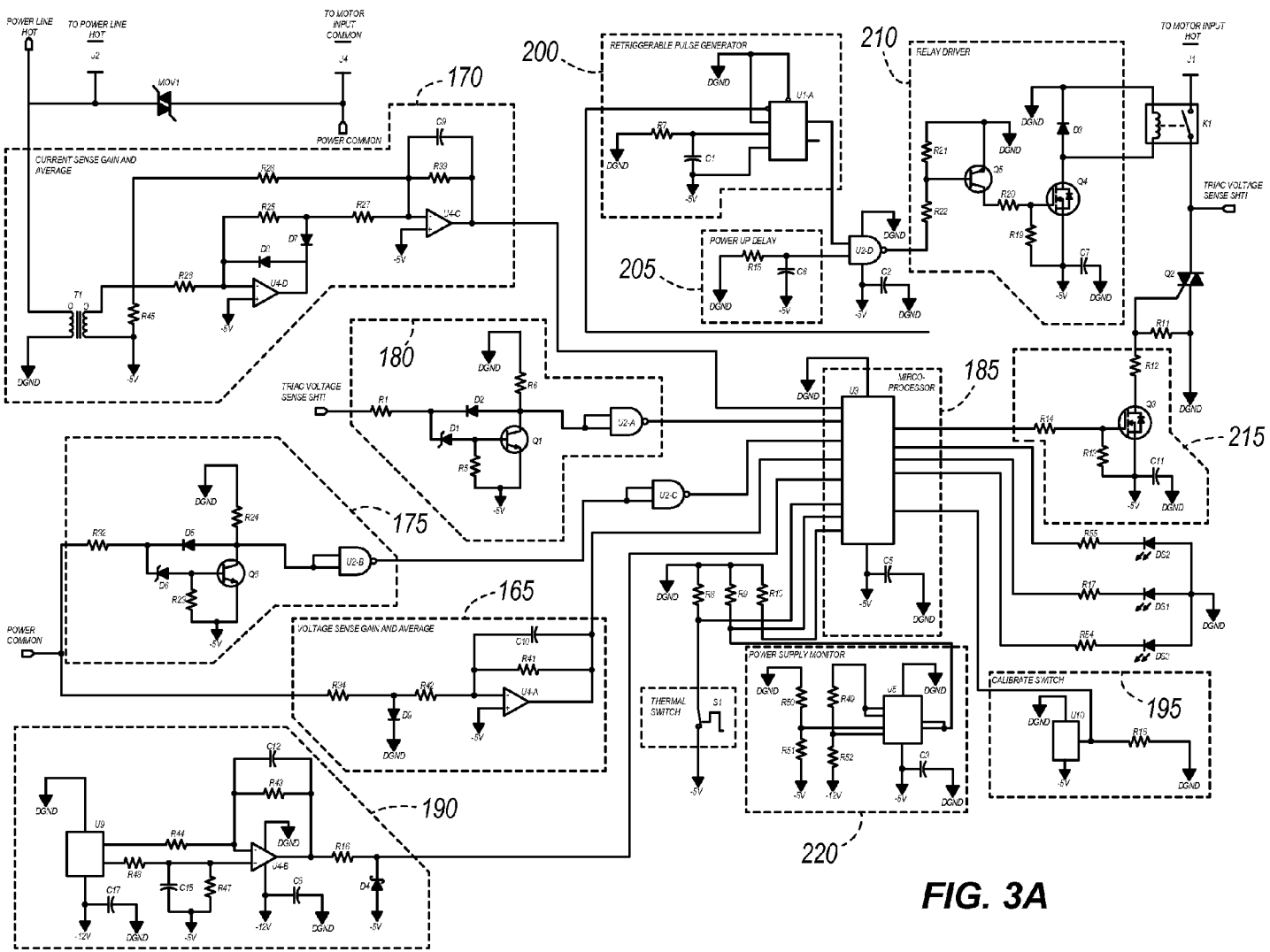
FIGS. 3A and 3B are electrical schematics of the first controller shown in FIG. 2.
Figure 3B:
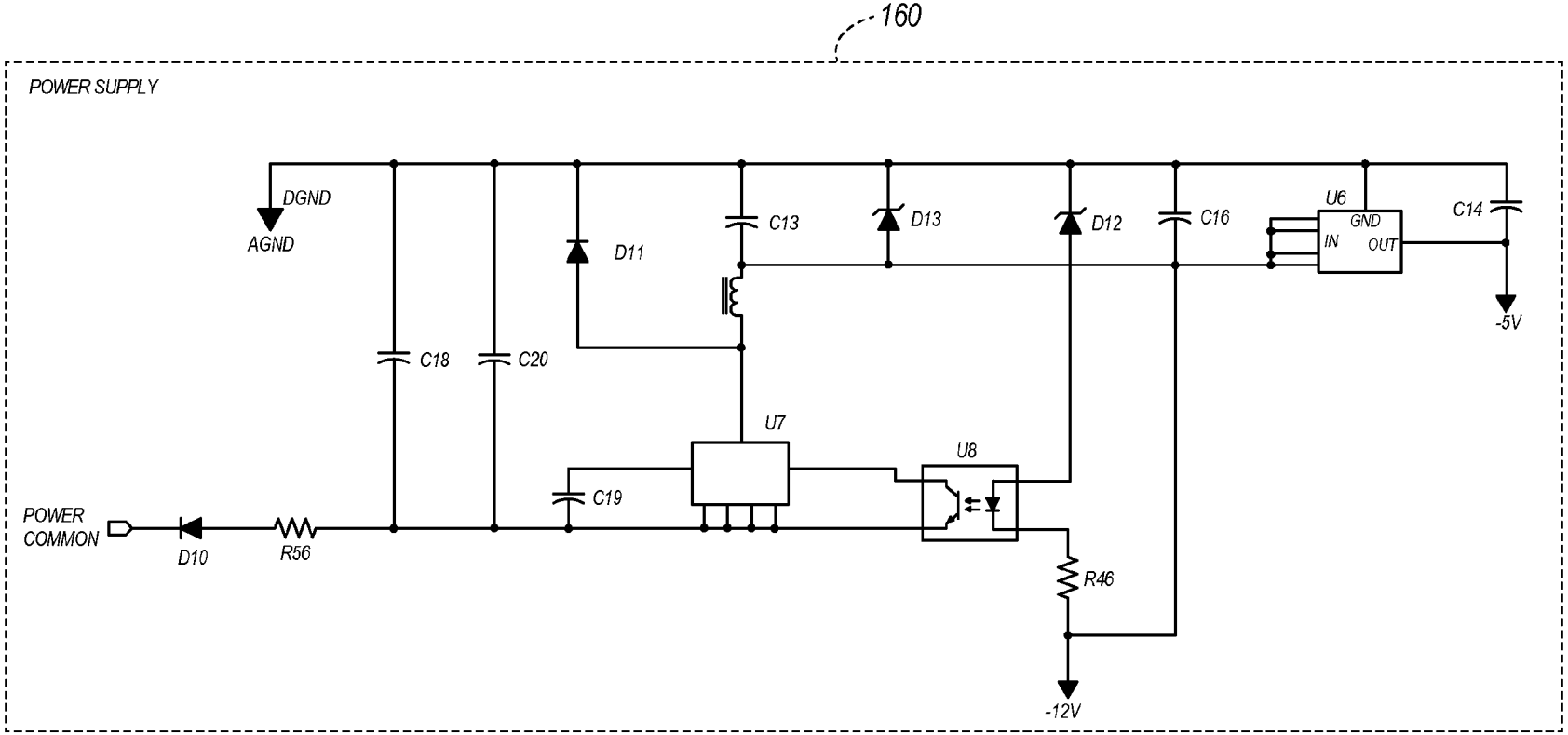

FIG. 2 is a block diagram of a first construction of the controller 150, and FIGS. 3A and 3B are electrical schematics of the controller 150. As shown in FIG. 2, the controller 150 is electrically connected to a power source 155 and the motor 145.

With reference to FIG. 2 and FIG. 3B, the controller 150 includes a power supply 160. The power supply 160 includes resistors R46 and R56; capacitors C13, C14, C16, C18, C19, and C20; diodes D10 and D11; zener diodes D12 and D13; power supply controller U7; regulator U6; and optical switch U8. The power supply 160 receives power from the power source 155 and provides the proper DC voltage (e.g., −5 VDC and −12 VDC) for operating the controller 150.

For the controller 150 shown in FIGS. 2 and 3A, the controller 150 monitors motor input power and pump inlet side pressure to determine if a drain obstruction has taken place. If the drain 115 or plumbing is plugged on the suction side of the pump 140, the pressure on that side of the pump 140 increases. At the same time, because the pump 140 is no longer pumping water, input power to the motor 145 drops. If either of these conditions occur, the controller 150 declares a fault, the motor 145 powers down, and a fault indicator lights.

A voltage sense and average circuit 165, a current sense and average circuit 170, a line voltage sense circuit 175, a triac voltage sense circuit 180, and the microcontroller 185 perform the monitoring of the input power. One example voltage sense and average circuit 165 is shown in FIG. 3A. The voltage sense and average circuit 165 includes resistors R34, R41, and R42; diode D9; capacitor C10; and operational amplifier U4A. The voltage sense and average circuit rectifies the voltage from the power source 155 and then performs a DC average of the rectified voltage. The DC average is then fed to the microcontroller 185.

One example current sense and average circuit 170 is shown in FIG. 3A. The current sense and average circuit 170 includes transformer T1 and resistor R45, which act as a current sensor that senses the current applied to the motor. The current sense and average circuit also includes resistors R25, R26, R27, R28, and R33; diodes D7 and D8; capacitor C9; and operational amplifiers U4C and U4D, which rectify and average the value representing the sensed current. For example, the resultant scaling of the current sense and average circuit 170 can be a negative five to zero volt value corresponding to a zero to twenty-five amp RMS value. The resulting DC average is then fed to the microcontroller 185.

One example line voltage sense circuit 175 is shown in FIG. 3A. The line voltage sense circuit 175 includes resistors R23, R24, and R32; diode D5; zener diode D6; transistor Q6; and NAND gate U2B. The line voltage sense circuit 175 includes a zero-crossing detector that generates a pulse signal. The pulse signal includes pulses that are generated each time the line voltage crosses zero volts.

One example triac voltage sense circuit 180 is shown in FIG. 3A. The triac voltage sense circuit 180 includes resistors R1, R5, and R6; diode D2; zener diode D1; transistor Q1; and NAND gate U2A. The triac voltage sense circuit includes a zero-crossing detector that generates a pulse signal. The pulse signal includes pulses that are generated each time the motor current crosses zero.

One example microcontroller 185 that can be used with the invention is a Motorola brand microcontroller, model no. MC68HC908QY4CP. The microcontroller 185 includes a processor and a memory. The memory includes software instructions that are read, interpreted, and executed by the processor to manipulate data or signals. The memory also includes data storage memory. The microcontroller 185 can include other circuitry (e.g., an analog-to-digital converter) necessary for operating the microcontroller 185. In general, the microcontroller 185 receives inputs (signals or data), executes software instructions to analyze the inputs, and generates outputs (signals or data) based on the analyses. Although the microcontroller 185 is shown and described, the invention can be implemented with other devices, including a variety of integrated circuits (e.g., an application-specific-integrated circuit), programmable devices, and/or discrete devices, as would be apparent to one of ordinary skill in the art. Additionally, it is envisioned that the microcontroller 185 or similar circuitry can be distributed among multiple microcontrollers 185 or similar circuitry. It is also envisioned that the microcontroller 185 or similar circuitry can perform the function of some of the other circuitry described (e.g., circuitry 165-180) above for the controller 150. For example, the microcontroller 185, in some constructions, can receive a sensed voltage and/or sensed current and determine an averaged voltage, an averaged current, the zero-crossings of the sensed voltage, and/or the zero crossings of the sensed current.

The microcontroller 185 receives the signals representing the average voltage applied to the motor 145, the average current through the motor 145, the zero crossings of the motor voltage, and the zero crossings of the motor current. Based on the zero crossings, the microcontroller 185 can determine a power factor. The power factor can be calculated using known mathematical equations or by using a lookup table based on the mathematical equations. The microcontroller 185 can then calculate a power with the averaged voltage, the averaged current, and the power factor as is known. As will be discussed later, the microcontroller 185 compares the calculated power with a power calibration value to determine whether a fault condition (e.g., due to an obstruction) is present.

Referring again to FIGS. 2 and 3A, a pressure (or vacuum) sensor circuit 190 and the microcontroller 185 monitor the pump inlet side pressure. One example pressure sensor circuit 190 is shown in FIG. 3A. The pressure sensor circuit 190 includes resistors R16, R43, R44, R47, and R48; capacitors C8, C12, C15, and C17; zener diode D4, piezoresistive sensor U9, and operational amplifier U4-B. The piezoresistive sensor U9 is plumbed into the suction side of the pump 140. The pressure sensor circuit 190 and microcontroller 185 translate and amplify the signal generated by the piezoresistive sensor U9 into a value representing inlet pressure. As will be discussed later, the microcontroller 185 compares the resulting pressure value with a pressure calibration value to determine whether a fault condition (e.g., due to an obstruction) is present.

The calibrating of the controller 150 occurs when the user activates a calibrate switch 195. One example calibrate switch 195 is shown in FIG. 3A. The calibrate switch 195 includes resistor R18 and Hall effect switch U10. When a magnet passes Hall effect switch U10, the switch 195 generates a signal provided to the microcontroller 185. Upon receiving the signal, the microcontroller 185 stores a pressure calibration value for the pressure sensor by acquiring the current pressure and stores a power calibration value for the motor by calculating the present power.

As stated earlier, the controller 150 controllably provides power to the motor 145. With references to FIGS. 2 and 3A, the controller 150 includes a retriggerable pulse generator circuit 200. The retriggerable pulse generator circuit 200 includes resistor R7, capacitor C1, and pulse generator U1A, and outputs a value to NAND gate U2D if the retriggerable pulse generator circuit 200 receives a signal having a pulse frequency greater than a set frequency determined by resistor R7 and capacitor C1. The NAND gate U2D also receives a signal from power-up delay circuit 205, which prevents nuisance triggering of the relay on startup. The output of the NAND gate U2D is provided to relay driver circuit 210. The relay driver circuit 210 shown in FIG. 3A includes resistors R19, R20, R21, and R22; capacitor C7; diode D3; and switches Q5 and Q4. The relay driver circuit 210 controls relay K1.

The microcontroller 185 also provides an output to triac driver circuit 215, which controls triac Q2. As shown in FIG. 3A, the triac driver circuit 215 includes resistors R12, R13, and R14; capacitor C11; and switch Q3. In order for current to flow to the motor, relay K1 needs to close and triac Q2 needs to be triggered on.

The controller 150 also includes a thermoswitch S1 for monitoring the triac heat sink, a power supply monitor 220 for monitoring the voltages produced by the power supply 160, and a plurality of LEDs DS1, DS2, and DS3 for providing information to the user. In the construction shown, a green LED DS1 indicates power is applied to the controller 150, a red LED DS2 indicates a fault has occurred, and a third LED DS3 is a heartbeat LED to indicate the microcontroller 185 is functioning. Of course, other interfaces can be used for providing information to the operator.

The following describes the normal sequence of events for one method of operation of the controller 150. When the fluid movement system 110 is initially activated, the system 110 may have to draw air out of the suction side plumbing and get the fluid flowing smoothly. This "priming" period usually lasts only a few seconds, but could last a minute or more if there is a lot of air in the system. After priming, the water flow, suction side pressure, and motor input power remain relatively constant. It is during this normal running period that the circuit is effective at detecting an abnormal event. The microcontroller 185 includes a startup-lockout feature that keeps the monitor from detecting the abnormal conditions during the priming period.

After the system 110 is running smoothly, the spa operator can calibrate the controller 150 to the current spa running conditions. The calibration values are stored in the microcontroller 185 memory, and will be used as the basis for monitoring the spa 100. If for some reason the operating conditions of the spa change, the controller 150 can be re-calibrated by the operator. If at any time during normal operations, however, the suction side pressure increases substantially (e.g., 12%) over the pressure calibration value, or the motor input power drops (e.g., 12%) under the power calibration value, the pump will be powered down and a fault indicator is lit.

As discussed earlier, the controller 150 measures motor input power, and not just motor power factor or input current. Some motors have electrical characteristics such that power factor remains constant while the motor is unloaded. Other motors have an electrical characteristic such that current remains relatively constant when the pump is unloaded. However, the input power drops on pump systems when the drain is plugged, and water flow is impeded.

The voltage sense and average circuit 165 generates a value representing the average power line voltage and the current sense and average circuit 170 generates a value representing the average motor current. Motor power factor is derived from the difference between power line zero crossing events and triac zero crossing events. The line voltage sense circuit 175 provides a signal representing the power line zero crossings. The triac zero crossings occur at the zero crossings of the motor current. The triac voltage sense circuit 180 provides a signal representing the triac zero crossings. The time difference from the zero crossing events is used to look up the motor power factor from a table stored in the microcontroller 185. This data is then used to calculate the motor input power using equation e1.

$$V_{avg}*I_{avg}*PF=\text{Motor_Input_Power} \quad [e1]$$

The calculated motor_input_power is then compared to the calibrated value to determine whether a fault has occurred. If a fault has occurred, the motor is powered down and the fault is lit.

Another aspect of the controller 150 is a "soft-start" feature. When a typical pump motor 145 is switched on, it quickly accelerates up to full speed. The sudden acceleration creates a vacuum surge on the inlet side of the pump 140, and a pressure surge on the discharge side of the pump 140. The vacuum surge can nuisance trip the hydraulic release valves of the spa 100. The pressure surge on the outlet can also create a water hammer that is hard on the plumbing and especially hard on the filter (if present). The soft-start feature slowly increases the voltage applied to the motor over a time period (e.g., two seconds). By gradually increasing the voltage, the motor accelerates more smoothly, and the pressure/vacuum spike in the plumbing is avoided.

Another aspect of the controller 150 is the use of redundant sensing systems. By looking at both pump inlet side pressure and motor input power, if a failure were to occur in either one, the remaining sensor would still shut down the system 110.

Redundancy is also used for the power switches that switch power to the motor. Both a relay and a triac are used in series to do this function. This way, a failure of either component will still leave one switch to turn off the motor 145. As an additional safety feature, the proper operation of both switches is checked by the microcontroller 185 every time the motor is powered on.

One benefit of using a triac Q2 in series with the relay K1 is that the triac Q2 can be used as the primary switching element, thus avoiding a lot of wear and tear on the relay contacts. When relay contacts open or close with an inductive motor or inductive load, arcing may occur, which eventually erodes the contact surfaces of the relay K1. Eventually the relay K1 will no longer make reliable contact or even stick in a closed position. By using the triac Q2 as the primary switch, the relay contacts can be closed before the triac completes the circuit to the motor 145. Likewise, when powering down, the triac Q2 can terminate conduction of current before the relay opens. This way there is no arcing of the relay contacts. The triac Q2 has no wear-out mechanism, so it can do this switching function repeatedly.

Another aspect of the controller 150 is the use of several monitoring functions to verify that all the circuits are working as intended. These functions can include verifying whether input voltage is in a reasonable range, verifying whether motor current is in a reasonable range, and verifying whether suction side pressure is in a reasonable range. For example, if motor current exceeds 135% of its calibrated value, the motor may be considered over-loaded and is powered down.

As discussed earlier, the controller 150 also monitors the power supply 160 and the temperature of the triac heat sink. If either is out of proper range, the controller 185 can power down the motor 145 and declare a fault. The controller 150 also monitors the line voltage sense and triac voltage sense circuits 175 and 180, respectively. If zero crossing pulses are received from either of these circuits at a frequency less than a defined time (e.g., every 80 milliseconds), the motor powers down.

Another aspect of the controller 150 is that the microcontroller 185 must provide pulses at a frequency greater than a set frequency (determined by the time constant of resistor R7 and C1) to close the relay K1. If the pulse generator U1A is not triggered at the proper frequency, the relay K1 opens and the motor powers down.

Thus, the invention provides, among other things, a controller for a motor operating a pump. While numerous aspects of the controller 150 were discussed above, not all of the aspects and features discussed above are required for the invention. For example, the controller 150 can be modified to monitor only motor input power or suction side pressure. Additionally, other aspects and features can be added to the controller 150 shown in the figures. For example, some of the features discussed below for controller 150*a* can be added to the controller 150.

Figure 4:
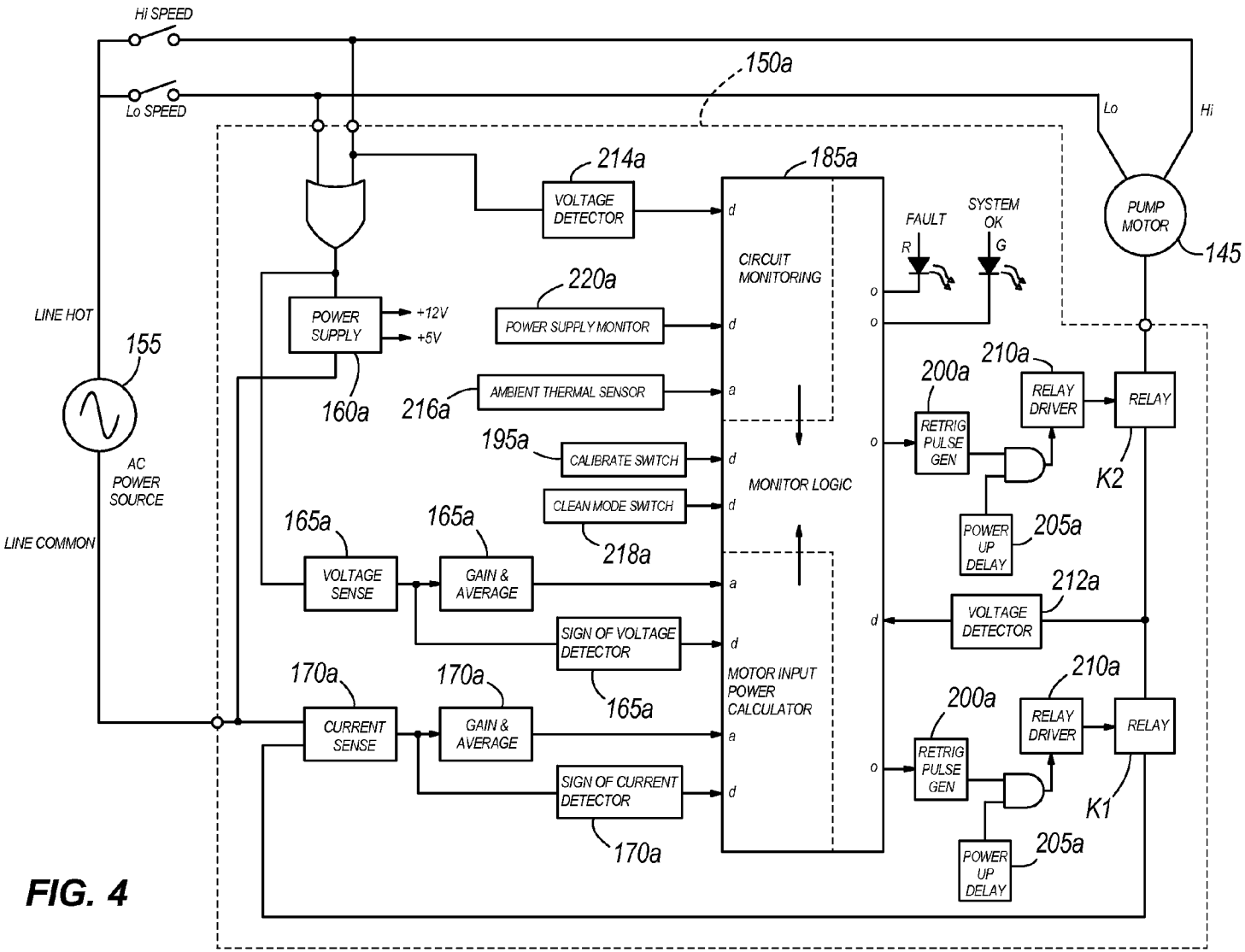
FIG. 4 is a block diagram of a second controller capable of being used in the jetted-spa shown in FIG. 1.
Figure 5A:
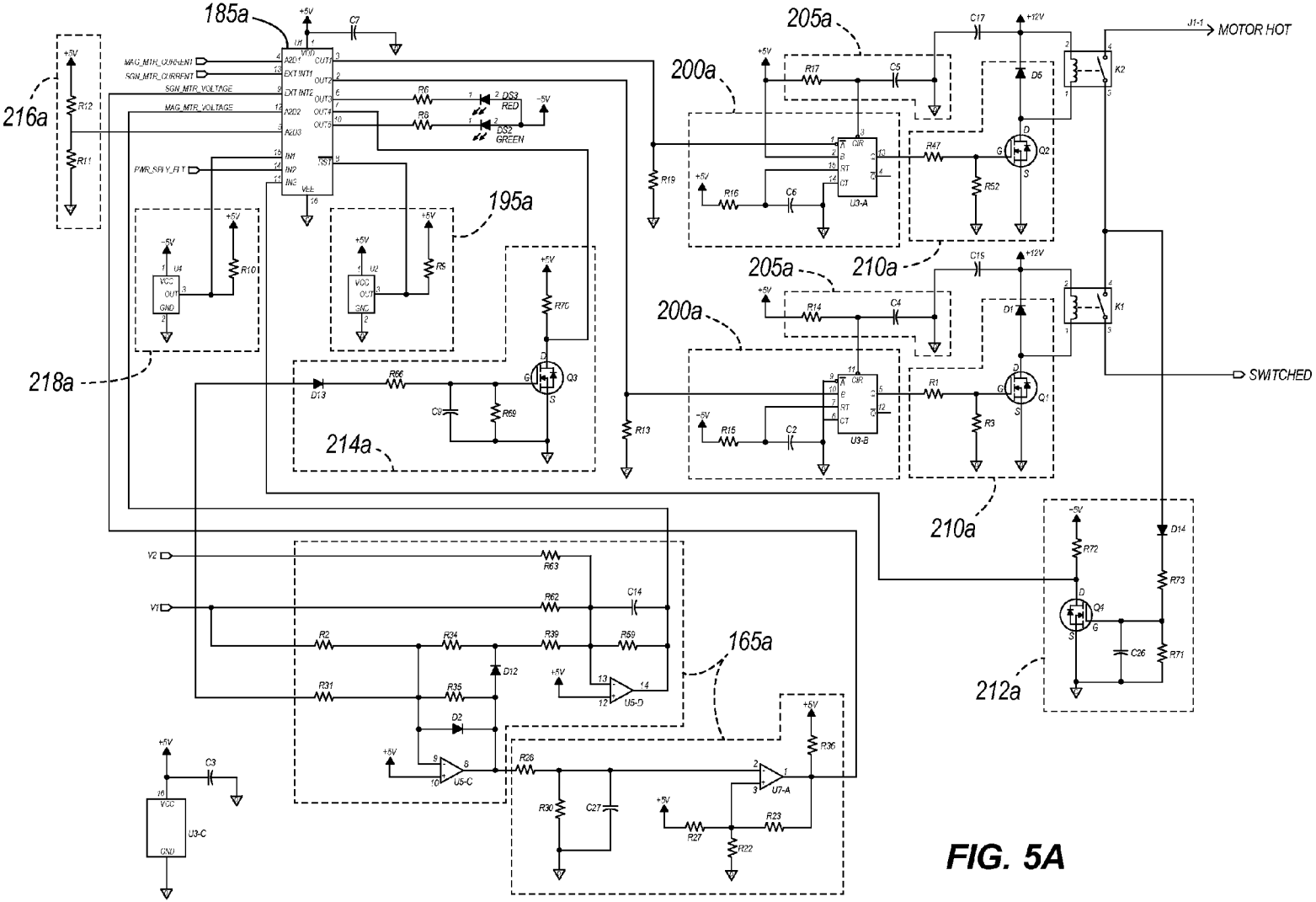
FIGS. 5A and 5B are electrical schematics of the second controller shown in FIG. 4.
Figure 5B:
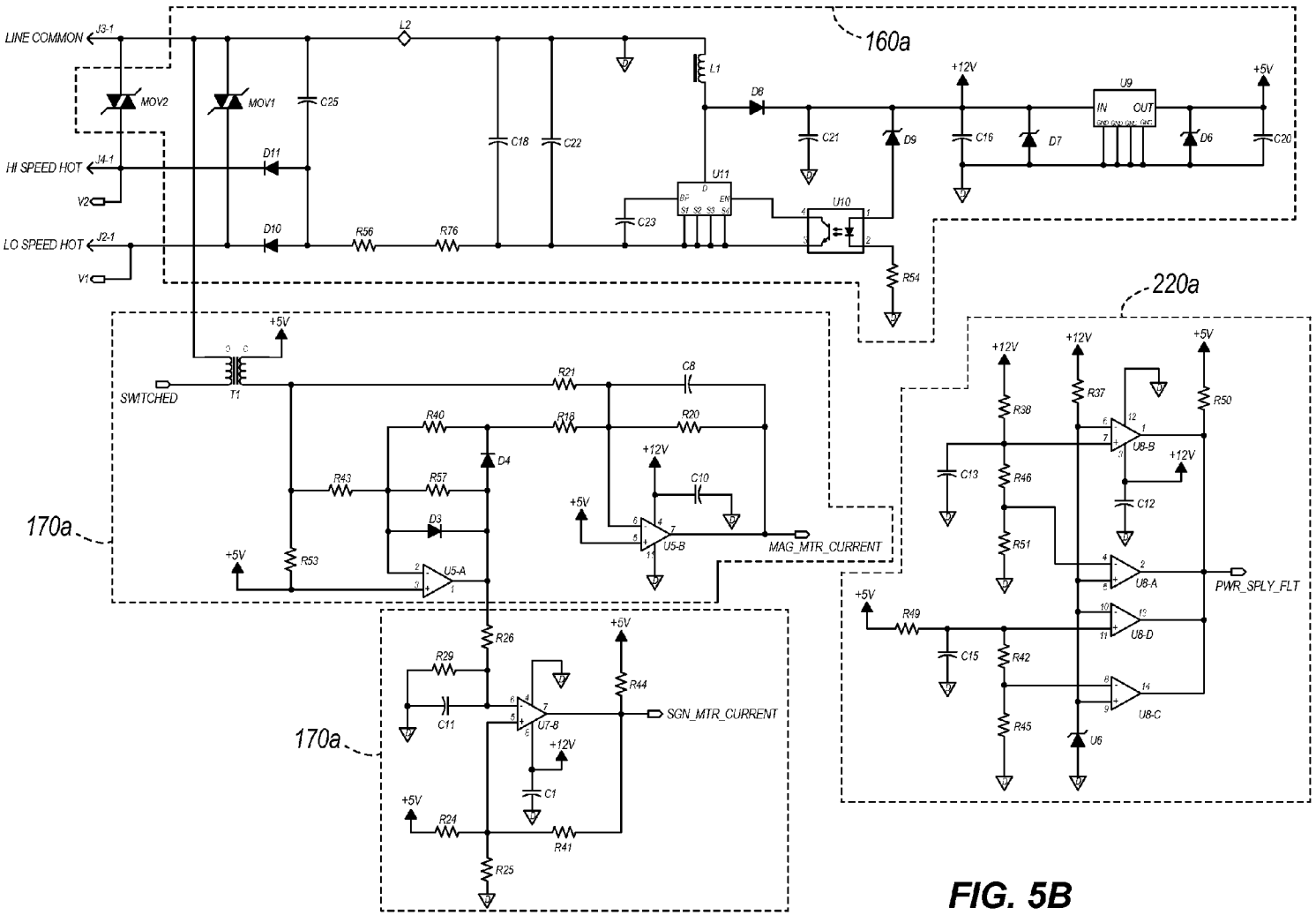

FIG. 4 is a block diagram of a second construction of the controller 150*a*, and FIGS. 5A and 5B are an electrical schematic of the controller 150*a*. As shown in FIG. 4, the controller 150*a* is electrically connected to a power source 155 and the motor 145.

With reference to FIG. 4 and FIG. 5B, the controller 150*a* includes a power supply 160*a*. The power supply 160*a* includes resistors R54, R56 and R76; capacitors C16, C18, C20, C21, C22, C23 and C25; diodes D8, D10 and D11; zener diodes D6, D7 and D9; power supply controller U11; regulator U9; inductors L1 and L2, surge suppressors MOV1 and MOV2, and optical switch U10. The power supply 160*a* receives power from the power source 155 and provides the proper DC voltage (e.g., +5 VDC and +12 VDC) for operating the controller 150*a*.

For the controller 150*a* shown in FIG. 4, FIG. 5A, and FIG. 5B, the controller 150*a* monitors motor input power to determine if a drain obstruction has taken place. Similar to the earlier disclosed construction, if the drain 115 or plumbing is plugged on the suction side of the pump 140, the pump 140 will no longer be pumping water, and input power to the motor 145 drops. If this condition occurs, the controller 150*a* declares a fault, the motor 145 powers down, and a fault indicator lights.

A voltage sense and average circuit 165*a*, a current sense and average circuit 170*a*, and the microcontroller 185*a* perform the monitoring of the input power. One example voltage sense and average circuit 165*a* is shown in FIG. 5A. The voltage sense and average circuit 165*a* includes resistors R2, R31, R34, R35, R39, R59, R62, and R63; diodes D2 and D12; capacitor C14; and operational amplifiers U5C and U5D. The voltage sense and average circuit 165*a* rectifies the voltage from the power source 155 and then performs a DC average of the rectified voltage. The DC average is then fed to the microcontroller 185*a*. The voltage sense and average circuit 165*a* further includes resistors R22, R23, R27, R28, R30, and R36; capacitor C27; and comparator U7A; which provide the sign of the voltage waveform (i.e., acts as a zero-crossing detector) to the microcontroller 185*a*.

One example current sense and average circuit 170*a* is shown in FIG. 5B. The current sense and average circuit 170*a* includes transformer T1 and resistor R53, which act as a current sensor that senses the current applied to the motor 145. The current sense and average circuit 170*a* also includes resistors R18, R20, R21, R40, R43, and R57; diodes D3 and D4; capacitor C8; and operational amplifiers U5A and U5B, which rectify and average the value representing the sensed current. For example, the resultant scaling of the current sense and average circuit 170*a* can be a positive five to zero volt value corresponding to a zero to twenty-five amp RMS value. The resulting DC average is then fed to the microcontroller 185*a*. The current sense and average circuit 170*a* further includes resistors R24, R25, R26, R29, R41, and R44; capacitor C11; and comparator U7B; which provide the sign of the current waveform (i.e., acts as a zero-crossing detector) to microcontroller 185*a*.

One example microcontroller 185*a* that can be used with the invention is a Motorola brand microcontroller, model no. MC68HC908QY4CP. Similar to what was discussed for the earlier construction, the microcontroller 185*a* includes a processor and a memory. The memory includes software instructions that are read, interpreted, and executed by the processor to manipulate data or signals. The memory also includes data storage memory. The microcontroller 185*a* can include other circuitry (e.g., an analog-to-digital converter) necessary for operating the microcontroller 185*a* and/or can perform the function of some of the other circuitry described above for the controller 150*a*. In general, the microcontroller 185*a* receives inputs (signals or data), executes software instructions to analyze the inputs, and generates outputs (signals or data) based on the analyses.

The microcontroller 185*a* receives the signals representing the average voltage applied to the motor 145, the average current through the motor 145, the zero crossings of the motor voltage, and the zero crossings of the motor current. Based on the zero crossings, the microcontroller 185*a* can determine a power factor and a power as was described earlier. The microcontroller 185*a* can then compare the calculated power with a power calibration value to determine whether a fault condition (e.g., due to an obstruction) is present.

The calibrating of the controller 150*a* occurs when the user activates a calibrate switch 195*a*. One example calibrate switch 195*a* is shown in FIG. 5A, which is similar to the calibrate switch 195 shown in FIG. 3A. Of course, other calibrate switches are possible. In one method of operation for the calibrate switch 195*a*, a calibration fob needs to be held near the switch 195*a* when the controller 150*a* receives an initial power. After removing the magnet and cycling power, the controller 150*a* goes through priming and enters an automatic calibration mode (discussed below).

The controller 150*a* controllably provides power to the motor 145. With references to FIGS. 4 and 5A, the controller 150*a* includes a retriggerable pulse generator circuit 200*a*. The retriggerable pulse generator circuit 200*a* includes resistors R15 and R16, capacitors C2 and C6, and pulse generators U3A and U3B, and outputs a value to the relay driver circuit 210*a* if the retriggerable pulse generator circuit 200*a* receives a signal having a pulse frequency greater than a set frequency determined by resistors R15 and R16, and capacitors C2 and C6. The retriggerable pulse generators U3A and U3B also receive a signal from power-up delay circuit 205*a*, which prevents nuisance triggering of the relays on startup. The relay driver circuits 210*a* shown in FIG. 5A includes resistors R1, R3, R47, and R52; diodes D1 and D5; and switches Q1 and Q2. The relay driver circuits 210*a* control relays K1 and K2. In order for current to flow to the motor, both relays K1 and K2 need to "close".

Figure 6:
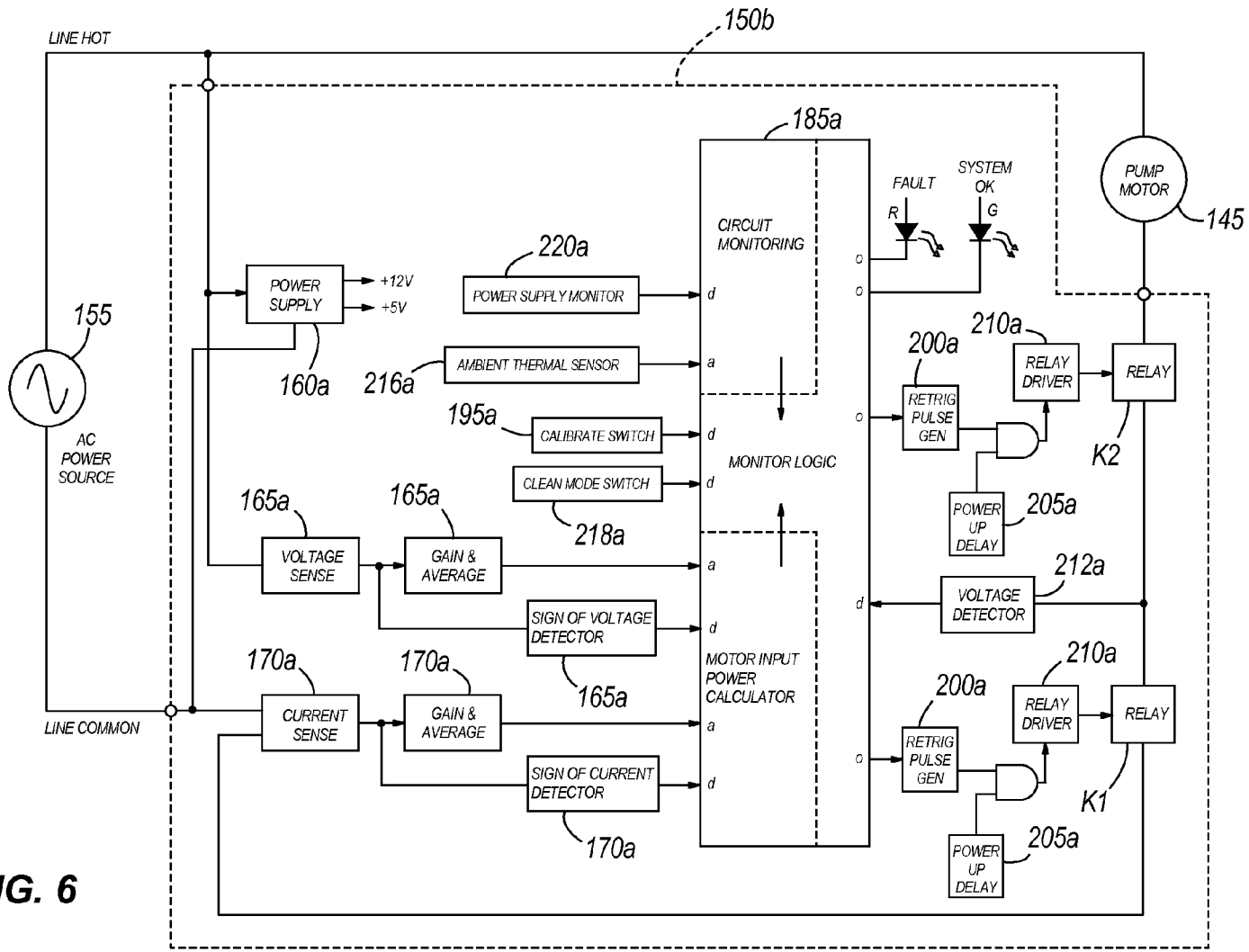
FIG. 6 is a block diagram of a third controller capable of being used in the jetted-spa shown in FIG. 1.

The controller 150*a* further includes two voltage detectors 212*a* and 214*a*. The first voltage detector 212*a* includes resistors R71, R72, and R73; capacitor C26; diode D14; and switch Q4. The first voltage detector 212*a* detects when voltage is present across relay K1, and verifies that the relays are functioning properly before allowing the motor to be energized. The second voltage detector 214*a* includes resistors R66, R69, and R70; capacitor C9; diode D13; and switch Q3. The second voltage detector 214*a* senses if a two speed motor is being operated in high or low speed mode. The motor input power trip values are set according to what speed the motor is being operated. It is also envisioned that the controller 150*a* can be used with a single speed motor without the second voltage detector 214*a* (e.g., controller 150*b* is shown in FIG. 6).

The controller 150*a* also includes an ambient thermal sensor circuit 216*a* for monitoring the operating temperature of the controller 150*a*, a power supply monitor 220*a* for monitoring the voltages produced by the power supply 160*a*, and a plurality of LEDs DS1 and DS3 for providing information to the user. In the construction shown, a green LED DS2 indicates power is applied to the controller 150*a*, and a red LED DS3 indicates a fault has occurred. Of course, other interfaces can be used for providing information to the operator.

The controller 150*a* further includes a clean mode switch 218*a*, which includes switch U4 and resistor R10. The clean mode switch can be depressed by an operator (e.g., a maintenance person) to deactivate the power monitoring function described herein for a time period (e.g., 30 minutes so that maintenance person can clean the vessel 105). After the time period, the controller 150*a* returns to normal operation.

The following describes the normal sequence of events for one method of operation of the controller 150*a*, some of which may be similar to the method of operation of the controller 150. When the fluid movement system 110 is initially activated, the system 110 may have to prime (discussed above) the suction side plumbing and get the fluid flowing smoothly (referred to as "the normal running period"). It is during the normal running period that the circuit is most effective at detecting an abnormal event.

After the system 110 enters the normal running period, the controller 150*a* can include instructions to perform an automatic calibration after priming upon a system power-up. The calibration values are stored in the microcontroller 185 memory, and will be used as the basis for monitoring the spa 100. If for some reason the operating conditions of the spa change, the controller 150*a* can be re-calibrated by the operator. If at any time during normal operation, however, the motor input power varies from the power calibration value (e.g., varies from a 12.5% window around the power calibration value), the pump motor 145 will be powered down and a fault indicator is lit.

Similar to controller 150, the controller 150*a* measures motor input power, and not just motor power factor or input current. However, it is envisioned that the controllers 150 or 150*a* can be modified to monitor other motor parameters (e.g., only motor current, only motor power factor, or motor speed). But motor input power is the preferred motor parameter for controller 150*a* for determining whether the water is impeded. Also, it is envisioned that the controller 150*a* can be modified to monitor other parameters (e.g., suction side pressure) of the system 110.

For some constructions of the controller 150*a*, the microcontroller 185*a* monitors the motor input power for an over power condition in addition to an under power condition. The monitoring of an over power condition helps reduce the chance that controller 150*a* was incorrectly calibrated, and/or also helps detect when the pump is over loaded (e.g., the pump is moving too much fluid).

The voltage sense and average circuit 165*a* generates a value representing the averaged power line voltage and the current sense and average circuit 170*a* generates a value representing the averaged motor current. Motor power factor is derived from the timing difference between the sign of the voltage signal and the sign of the current signal. This time difference is used to look up the motor power factor from a table stored in the microcontroller 185*a*. The averaged power line voltage, the averaged motor current, and the motor power factor are then used to calculate the motor input power using equation e1 as was discussed earlier. The calculated motor input power is then compared to the calibrated value to determine whether a fault has occurred. If a fault has occurred, the motor is powered down and the fault indicator is lit.

Redundancy is also used for the power switches of the controller 150*a*. Two relays K1 and K2 are used in series to do this function. This way, a failure of either component will still leave one switch to turn off the motor 145. As an additional safety feature, the proper operation of both relays is checked by the microcontroller 185*a* every time the motor 145 is powered on via the relay voltage detector circuit 212*a*.

Another aspect of the controller 150*a* is the use of several monitoring functions to verify that all the circuits are working as intended. These functions can include verifying whether input voltage is in a reasonable range (i.e. 85 to 135 VAC, or 175 to 255 VAC), and verifying whether motor current is in a reasonable range (5% to 95% of range). Also, if motor current exceeds 135% of its calibrated value, the motor may be considered over-loaded and is powered down.

The controller 150*a* also monitors the power supply 160*a* and the ambient temperature of the circuitry of the controller 150*a*. If either is out of proper range, the controller 150*a* will power down the motor 145 and declare a fault. The controller 150*a* also monitors the sign of the power line voltage and the sign of the motor current. If the zero crossing pulses resulting from this monitoring is at a frequency less than a defined time (e.g., every 30 milliseconds), then the motor powers down.

Another aspect of the controller 150*a* is that the microcontroller 185*a* provides pulses at a frequency greater than a set frequency (determined by the retriggerable pulse generator circuits) to close the relays K1 and K2. If the pulse generators U3A and U3B are not triggered at the proper frequency, the relays K1 and K2 open and the motor powers down.

Another aspect of some constructions of the controller 150*a* is that the microcontroller 185*a* includes an automatic reset feature, which may help to recognize a nuisance trip (e.g., due to an air bubble in the fluid-movement system 110). For this aspect, the microcontroller 185*a*, after detecting a fault and powering down the motor, waits a time period (e.g., a minute), resets, and attempts to start the pump. If the controller 150*a* cannot successfully start the pump after a defined number of tries (e.g., five), the microcontroller 185*a* locks until powered down and restarted. The microcontroller 185*a* can further be programmed to clear the fault history if the pump runs normally for a time period.

The microcontroller 185*a* can include a startup-lockout feature that keeps the monitor from indicating abnormal conditions during a priming period, thereby preventing unnecessary nuisance trips. In one specific method of operation, the microcontroller 185*a* initiates a lockout-condition upon startup, but monitors motor input power upon startup. If the pump 140 is priming, the input is typically low. Once the input power enters a monitoring window (e.g., within 12.5% above or below the power calibration value) and stays there for a time period (e.g., two seconds), the microcontroller 185 ceases the lockout condition and enters normal operation even though the pump may not be fully primed. This feature allows the controller 150*a* to perform normal monitoring as soon as possible, while reducing the likelihood of nuisance tripping during the priming period. For example, a complete priming event may last two-to-three minutes after the controller 150*a* is powered up. However, when the motor input power has entered the monitoring window, the suction force on the inlet 115 is sufficient for entrapment. By allowing the controller to enter run mode at this point, the likelihood of a suction event is greatly reduced through the remaining portion of the priming period. Therefore, the just-described method of operation for ceasing the lockout condition provides a greater efficiency of protection than a timed, startup lockout.

While numerous aspects of the controller 150*a* were discussed above, not all of the aspects and features discussed above are required for the invention. Additionally, other aspects and features can be added to the controller 150*a* shown in the figures.

The constructions described above and illustrated in the figures are presented by way of example only and are not intended as a limitation upon the concepts and principles of the invention. Various features and advantages of the invention are set forth in the following claims.

What is claimed is:

1. A pumping apparatus for a jetted-fluid system comprising a vessel for holding a fluid, a drain, and a return, the pumping apparatus being connectable to a power source and comprising:

a pump comprising an inlet connectable to the drain, and an outlet connectable to the return, the pump adapted to receive the fluid from the drain and jet fluid through the return;

a motor coupled to the pump to operate the pump, the motor configured to operate at a first speed and at least one second speed;

a current sensor coupled to the motor and configured to generate a first signal having a relation to a current applied to the pump motor;

a switch connectable to the power source, coupled to the motor, and configured to control the current through the motor;

a controller coupled to the current sensor and the switch, the controller configured to determine a voltage having a relation to the motor and generate a value to control the motor based on the first signal, the determined voltage, and a phase angle between the first signal and the determined voltage, the value having a relation to a motor power value, the controller further configured to monitor the value, determine whether the monitored value indicates an undesired flow of fluid through the pump, and control the motor to cease operation of the pump based on the determination indicating the undesired flow of fluid through the pump; and a first circuitry coupled to the current sensor and to the controller, the first circuitry configured to receive the first signal and produce a second signal representing an averaged value for the first signal.

2. A pumping apparatus as set forth in claim 1 wherein the determination whether the monitored value indicates the undesired flow of fluid comprises the controller being further configured to determine whether the monitored value indicates an undesired low fluid inlet flow, and wherein the control of the motor to cease operation of the pump when the determination indicates the undesired flow of fluid comprises the controller being further configured to control the motor to cease operation of the pump based on the determination indicating the undesired low fluid inlet flow.

3. A pumping apparatus as set forth in claim 1 wherein the determination whether the monitored value indicates the undesired flow of fluid comprises the controller being further configured to determine whether the monitored value indicates an undesired high fluid outlet flow, and wherein the control of the motor to cease operation of the pump when the determination indicates the undesired flow of fluid comprises the controller being further configured to control the motor to cease operation of the pump based on the determination indicating the undesired high fluid outlet flow.

4. A pumping apparatus as set forth in claim 1 wherein the controller comprises a memory configurable to store a calibration value, and wherein the determination whether the monitored value indicates the undesired flow of fluid comprises the controller being further configured to determine whether the monitored value is not within a window of the calibration value, the window indicative of a desired flow of fluid through the pump.

5. A pumping apparatus as set forth in claim 1 wherein the controller comprises a memory configurable to store a threshold indicative of an undesired low fluid inlet flow, and wherein the determination whether the monitored value indicates the undesired flow of fluid comprises the controller being further configured to determine whether the monitored value is less than the threshold.

6. A pumping apparatus as set forth in claim 1 wherein the controller comprises a memory configurable to store a threshold indicative of an undesired high fluid outlet flow, and wherein the determination whether the monitored value indicates the undesired flow of fluid comprises the controller being further configured to determine whether the monitored value is greater than the threshold.

7. A pumping apparatus as set forth in claim 1 wherein the pumping apparatus further comprises a pressure sensor coupled to the pump inlet and configured to generate a second signal having a relation to the pump inlet side pressure, wherein the controller is coupled to the pressure sensor, and wherein the controller is further configured to control the motor based on the second signal.

8. A pumping apparatus as set forth in claim 1 wherein the motor is a brushless direct current motor.

9. A controller configured to control the operation of a pumping apparatus for a jetted-fluid system, the controller comprising:

a memory;

a processor connected to the memory and configured to access executable instructions stored within the memory related to the operation of the pumping apparatus;

a current sensor connectable to the processor and operable to provide, to the processor, a signal having a relation to a current applied to a motor;

the controller configured to determine a voltage having a relation to the motor, generate a value based on the signal, the determined voltage, and a phase angle between the signal and the determined voltage to control the motor, compare the value to a threshold value, and determine whether the value is indicative of a fault condition of the jetted-fluid system, wherein the fault condition is indicative of a suction-entrapment condition.

10. The controller of claim 9, wherein the controller is further configured to control the motor.

11. The controller of claim 10, wherein the controller is further configured to generate control signals for operating the motor at a first speed and at least one second speed.

12. The controller of claim 9, further comprising a pressure sensor connectable to the processor and operable to provide a signal having a relation to an inlet pressure of the pumping apparatus.

13. The controller of claim 9, wherein the threshold value is a motor input power threshold value.

14. The controller of claim 9, wherein the controller is further configured to be calibrated based on current conditions of the jetted-fluid system.

15. The controller of claim 9, wherein the controller is further configured to compare the value to a range of values around the threshold value.

16. The controller of claim 9, wherein the controller is further configured to cease operation of the pumping apparatus when the value is indicative of the fault condition of the jetted-fluid system.

17. The controller as set forth in claim 9 wherein the motor is a brushless direct current motor.

* * * * *